United States Patent [19]

Ravotti et al.

[11] Patent Number: 4,719,731

[45] Date of Patent: Jan. 19, 1988

[54] POST COVER FOR PARTITION SYSTEMS

[75] Inventors: Gary P. Ravotti, Poland; Bill J. Shamblin, Hubbard, both of Ohio

[73] Assignee: GF Furniture Systems, Inc., Youngstown, Ohio

[21] Appl. No.: 944,529

[22] Filed: Dec. 22, 1986

[51] Int. Cl.[4] ..... E04B 2/74

[52] U.S. Cl. ..... 52/239; 52/242; 52/243; 52/461

[58] Field of Search ..... 52/239, 242, 243, 281, 52/282, 460, 464, 468, 471, 481, 775, 781, 461

[56] References Cited

U.S. PATENT DOCUMENTS

| | | | |
|---|---|---|---|
| 2,360,500 | 10/1944 | Johnson | 52/781 |
| 3,049,195 | 8/1962 | Leat et al. | 52/775 |
| 3,350,828 | 11/1967 | Russell | 52/281 |

OTHER PUBLICATIONS

French Patent Document 84,464, 1st Add. French Patent 1,311,348, Jan. 11, 1965, 1 page of drawing, 2 pages of specification.

*Primary Examiner*—James L. Ridgill, Jr.
*Attorney, Agent, or Firm*—Richard C. Litman

[57] ABSTRACT

A partition system post cover includes an elongated cover plate serving to mask a support post between two adjacent panels. Edge channels on the panels are provided with slots and fastener assemblies carried by the cover plate include spring arms insertable into selected edge channel slots to securely yet removably retain the cover in a position overlying the post. The cover plate may be configured to accommodate various angular dispositions between adjacent supported panels to insure full masking of the support post.

7 Claims, 6 Drawing Figures

POST COVER FOR PARTITION SYSTEMS

This invention relates generally to partition systems and more particularly to an improved arrangement including removable cover elements for overlying and masking the posts or uprights supporting one or more panels of an office partition system.

BACKGROUND OF THE INVENTION

Numerous partition systems have been developed allowing for the ready partitioning of work spaces particularly in offices. Conventionally, these systems comprise a plurality of rigid panels having attachment elements along their vertical edges and which cooperate with endmost and intermediate vertical uprights or support posts to fixedly retain the plurality of panels in a sturdy upright manner. By serially arranging the plurality of panels in a combination of straight line and angular disposition, an almost limitless configuration may be achieved according to the requirements of the user. Most often, the juncture between adjacent panels, at which point the support post is located, remains exposed to the user's view, and thus may be considered to provide an unsightly condition. With the present system, a cover member is provided which carries one or more fastener assemblies adapted to engage existing structure present in the area of the support post, to provide ready means for the rapid attachment or removal of the post cover members.

Removable cover elements for partition systems are generally well known. Cover members have been retained by means of Velcro strips and magnets. Such methods fail to provide a positive rigid attachment and present a problem in achieving accurate registry between a cover and the underlying partition components. U.S. Pat. No. 4,404,785 issued to McCracken et al. on Sept. 20, 1983, illustrates a removable cover member adapted to mask the support assembly normally found beneath the lower edge of a partition support post. The present invention improves upon the construction of the above McCracken et al. device by providing a removable cover intended to fully mask the area between adjacent partition panels from the top to the bottom of the post member itself.

SUMMARY OF THE INVENTION

With the present construction, a post cover is provided having a width substantially equal to the lateral distance normally existing between two adjacent panels affixed to a common support post. This cover is configured to slidably receive and retain one or more fastener assemblies constructed of resilient material with each having a pair of resilient curved arms extending from the rear of the cover. These arms are adapted to be sequentially inserted within slots of the respective slotted channels carried by the edges of two panels abutting each support post. Accordingly, it will be appreciated that the front or outer face of the cover may be curved or otherwise configured according to the angular disposition of any two adjacent panels. Thus, in the case of a straight line assembly of adjacent panels, the front face of the cover will be substantially flat while in the case of an outside angle such as 90°, 120°, or 135° formed between two adjacent panels, the respective post cover will be appropriately curved in cross section to accommodate the angular disposition of the panels and still provide the required masking of the otherwise exposed intermediate support post.

Accordingly, one of the objects of the present invention is to provide an improved post cover for partition systems including an elongated cover plate having a center portion bounded by two side flanges with one or more resilient fastener assemblies carried by the cover member adapted to engage slots provided in edge channels of the partition system.

Another object of the present invention is to provide an improved post cover for partition systems including an elongated cover plate extending the height of the support post and vertically slidably retaining a plurality of fastener assemblies removably attachable to components of the partition system.

The object of the present invention is to provide an improved post cover for partition systems including an elongated cover plate having side flanges slidably retaining a plurality of resilient fastener assemblies each provided with a pair of curved flexible arms sequentially insertable within slots provided in edge channels contained in the partition system.

Still another object of the present invention is to provide an improved post cover for partition systems including a cover plate containing a plurality of fastener assemblies with the cover plate arcuately configured to fully mask an outside angle formed by two supported panels disposed 90° to 135° with respect to one another.

With these and other objects in view which will more readily appear as the nature of the invention is better understood, the invention consists in the novel construction, combination and arrangement of parts hereinafter more fully illustrated and claimed, with reference being made to the accompanying drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
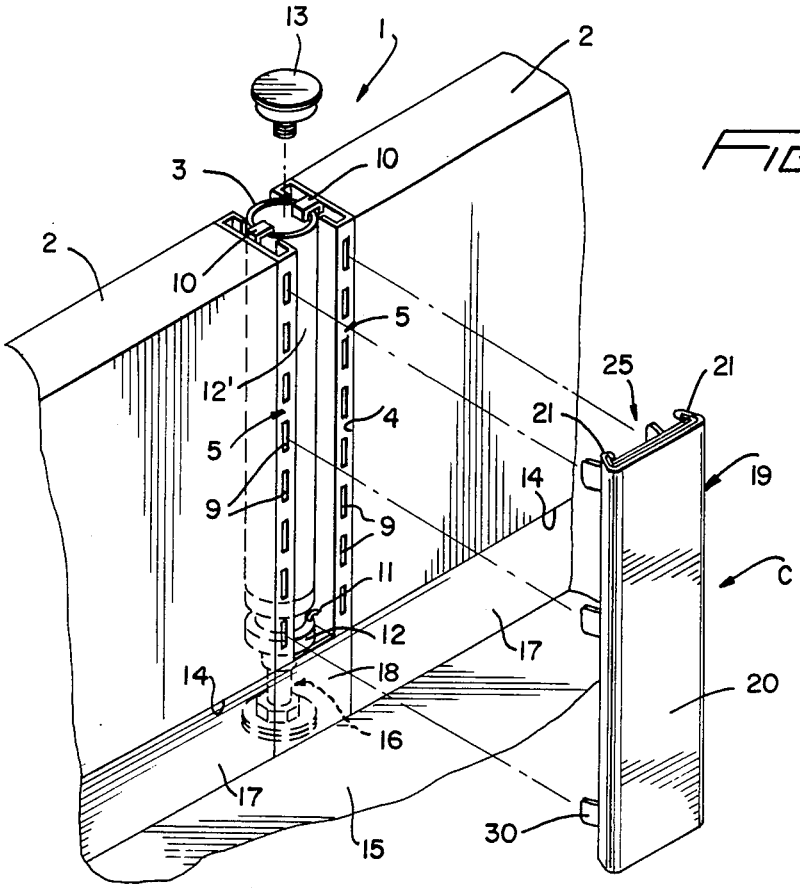
FIG. 1 is a partial front prospective view of a partition assembly with a post cover according to the present invention, as it appears prior to installation.

The present invention will be seen to relate to a partition assembly, generally designated 1, and which includes two or more panels 2 each of substantially planar construction and adapted to be supported and retained in a vertical plane by means of an upright or support post 3 positioned intermediate the side edges 4—4 of each pair of adjacent panels 2. The panels are usually attached to the post 3 by means of hooks or other devices projecting outwardly from each panel side edge 4 and engageable with the post adjacent its top and bottom.

In the present instance, the panel side edges 4 are provided with an edge channel 5 suitably affixed thereto and including a substantially "C" shaped element having a base 6 attached to the panel side edge 4 and two side walls 7—7 further terminating in an inturned flange 8. A series of vertically elongated slots 9 are provided in each of the edge channel side walls 7 which in the past have served to provide attachment means for the mounting of appropriate arms or brackets allowing for the attachment of various partition accessories, such as shelving or bookcases. In the case of the present invention, as will be seen hereinbelow, the slotted edge channels provide attachment means for removably receiving a post cover C.

The attachment of the panel 2 to the post 3 is readily accomplished by providing a top hook 10 projecting inwardly from the upward portion of each edge channel 5 and a lower hook 11 adjacent the bottom of each edge channel. The posts 3 are preferably cylindrical and hollow and this construction readily admits the top hook 10 into the interior of the post while the lower hook 11 may engage the interior of a cup 12 attached to the bottom of the post.

Figure 2:
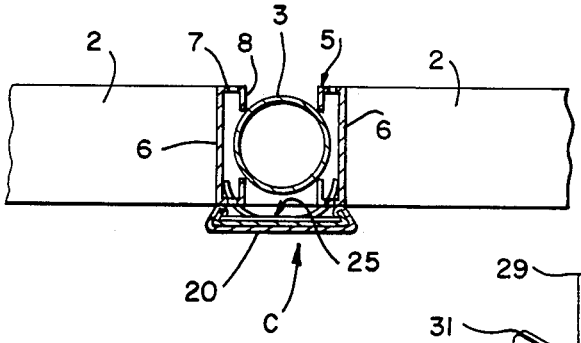
FIG. 2 is a horizontal cross-sectional view, taken along the line 2—2 of FIG. 1, with the post cover fully installed.
Figure 3:
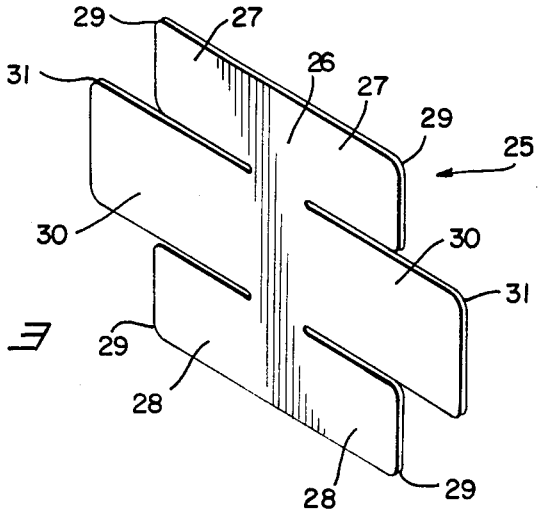
FIG. 3 is a prospective view of one of the fastener assemblies carried by the cover.
Figure 4:
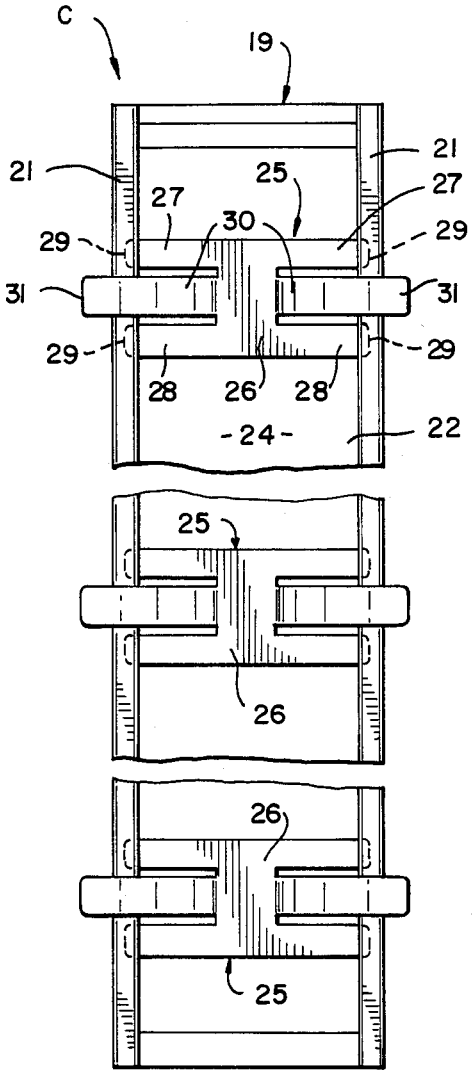
FIG. 4 is a partial rear elevation of the cover with one of the fastener assemblies installed therein.

From a review of FIGS. 1 and 2 of the drawings, it will be seen that when any two adjacent panels are thusly attached to an intermediate post 3, the inturned flanges 8 of the two panel edge channels are juxtaposed the periphery 12' of the post. This assembly of a post and plurality of panels may be secured by the application of a top cap 13 adapted to be secured to the upper portion of the post in a manner overlying the edge channel top hooks 10.

Usually it is desirable to support the panels 2 with their bottom edges 14 elevated with respect to the supporting floor 15. This is accomplished by means of a post support assembly 16 attached to the post cup 12 and which may allow leveling or adjustment of the vertical disposition of the post 3 to accommodate any uneveness in the support structure 15.

Covers or masking means to enclose the open space beneath the panel bottom edges 14 as well as beneath the post cup 12 are well known, as shown in the previously mentioned U.S. Pat. No. 4,404,785. Such cover members may be utilized along with the present invention such as in FIG. 1 which illustrates panel trim members beneath the panels and a post base cover 18 beneath the post and overlying the support assembly 16.

Figure 5:
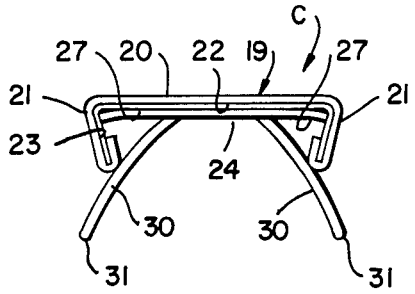
FIG. 5 is an enlarged horizontal sectional view of the cover with a fastener assembly installed therein.

Post cover C comprises an elongated cover plate 19 constructed either of metal or suitable plastics and which includes a front wall 20 having a lateral extent which is no less than the lateral extent or diameter of the upright 3. Extending rearwardly from the edges of the front wall 20 are a pair of side walls or flanges 21—21 which from FIGS. 2 and 5 of the drawings will be seen to be slightly inclined inwardly toward one another for reasons which will become obvious hereinafter. The rear wall 22 of the cover plate 19, together with the inner surfaces 23 of the two side flanges 21 define an interior cavity 24 adapted to receive one or more fastener assemblies, generally designated 25.

Each fastener assembly 25 comprises a resilient clip member preferably formed of spring steel and including a mounting base 26 from which laterally extend, a pair of upper and lower tabs 27 and 28, respectively. The rounded ends 29 of each tab form a close sliding fit as each fastener assembly 25 is axially inserted from either end of a post cover into the interior cavity 24 thereof. It will be apparent that the dimensions of the lateral extent of the fastener tabs 27,28 are selected to ensure a close sliding fit within the cover cavity 24 adjacent the rear wall 22 thereof. Transverse displacement of the thus attached fasteners is precluded in view of the inward inclination of the two side walls 21 of the cover such that only axial sliding displacement of the fastener is possible.

Extending from the medial portion of the mounting base 26 of each fastener are a pair of laterally projecting deflectable curved arms 30—30 each terminating in a rounded end 31. The curved arms define a substantially constant radius arc extending from the fastener mounting base 26 a substantially greater distance than the upper and lower tabs 27–28 and normally abut the free edge 32 of the respective side wall 21.

Any number of fastener assemblies 25 may be carried by any one post cover C. At least two such fasteners will be called for to provide secure attachment of both ends of a cover and most often additional fasteners should be employed, depending upon the length of the cover, which will be understood to be related to the height of the associated panels 2. In any case the resilient nature of the unitary fasteners and the rounded construction of the tab ends 29 permits ready insertion of any number of fasteners from either end of the cover plate 19 and subsequent axial sliding thereof to selectively space apart the inserted fasteners.

With the fasteners 25 mounted within a cover plate 19, the ends 31 of those arms 30 projecting from one side of the cover plate are sequentially or concurrently inserted into selected ones of the slots 9 of one edge channel 5. If necessary, in order to achieve proper registry, one or more of the fasteners 25 may be axially shifted within the cover plate cavity 24. Thereafter, the remaining arms 30 projecting from the opposite side of the cover are urged into juxtaposed slots of the other edge channel 5 as the cover plate is swung inwardly.

When thusly installed, the ends 31 of all of the fastener arms will be understood to be disposed well behind the respective slots and the curved configuration of the resilient arms 30 provides a constant biasing action maintaining the free edges 32 of the cover side walls 21 in abutment with the panel edge channels 5.

Figure 6:
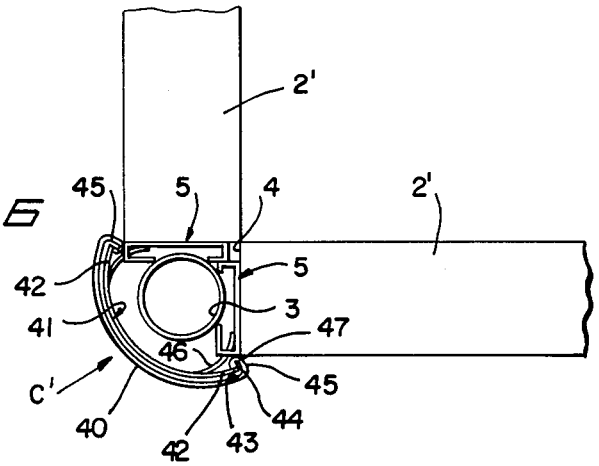
FIG. 6 is a partial top plan view illustrating an alternative panel disposition and post cover configuration.

The cover C' shown in FIG. 6 of the drawings comprises the same basic construction as the previously described arrangement. In this embodiment the panels 2'—2' are angularly disposed at an angle other than 180 degrees and accordingly the cover plate 40 and fastener assembly 41 are laterally enlarged and curved in cross-section to accommodate the different configuration of the exposed area between the two panel edges 4—4. At least when installed, the fastener tabs 42 will be seen to be curved to match the curvature of the inner surface 43 of the cover plate 40. The rounded ends 44 of the tabs are still retained in the area of the juncture of the inner surface 43 and the inwardly directed side walls 45 while the curved arms 46 normally rest upon the free edges 47 of the side walls 45. The attachment of the modified post cover C' is achieved in the same manner as that previously described, by the insertion of first, the fastener arms 46 projecting from one side of the post cover into selected slots 9 of one exposed edge channel 5 and second, by the insertion of the remaining curved arms 46 projecting from the other side of the post cover, into selected slots of the other exposed edge channel 5.

Inasmuch as the present invention is subject to many modifications, variations and changes in details, it is intended that all matter contained in the foregoing description or shown on the accompanying drawings, shall be interpreted as illustrative and not in a limiting sense.

We claim:

1. In a partition assembly having at least two adjacent panels each having a side edge attached to an intermediate support post, slotted edge channels carried by each panel side edge juxtaposed said support port and spaced apart from one another to define a normally exposed gap spanning said spaced apart edge channels, the improvement comprising; an elongated post cover removably attachable to said assembly to mask said support post and gap between said panel side edges, said cover including a cover plate having a rear wall and a front wall laterally extending at least the distance between said two spaced apart edge channels, a fastener assembly carried by said cover plate including a medial mounting base overlying said rear wall and having a pair of deflectable resilient arms extending rearwardly and laterally from said cover plate, inwardly inclined side walls projecting rearwardly from said cover front wall, inner surfaces on said side walls defining with said rear wall an interior cavity, at least one tab laterally projecting from each side of said fastener assembly mounting base and respectively engageable with said cover plate side walls to captively retain said fastener assembly within said interior cavity juxtaposed said rear wall while allowing selective longitudinal displacement of said fastener assembly within said cavity of said elongated post cover, whereby said fastener assembly is slidably displaceable within said cavity along the axial extent of said elongated cover to align said arms with a selected pair of respective slots in said two edge channels, and said arms respectively insertable into said selected pair of said slots in said edge channels of said two adjacent panels and thereupon deflected as said post cover is urged toward said edge channels to retain said post cover in a position overlying said post and masking said gap as said arms resiliently engage said slots.

2. A partition assembly according to claim 1 wherein said fastener arms comprise curved members.

3. A partition assembly according to claim 1 wherein said adjacent panels are substantially co-planar and said cover plate front wall is substantially planar.

4. A partition assembly according to claim 1 wherein said adjacent panels are angularly disposed to one another at an angle other than 180° and said cover plate front wall is curved in cross-section.

5. A partition assembly according to claim 1 including rounded ends on said tabs slidably engageable with said side walls.

6. A partition assembly according to claim 1 including upper and lower pairs of said tabs and said arms disposed intermediate said pairs of arms.

7. A partition assembly according to claim 1 including, a plurality of said fastener assemblies carried by said post cover.

* * * * *